United States Patent [19]

Dehnert et al.

[11] Patent Number: 4,642,818

[45] Date of Patent: Feb. 17, 1987

[54] PANTY-LIKE GARMENT OF TEXTILE MATERIAL

[76] Inventors: Christiane Dehnert; Heinz Dehnert, both of Im Mittleren Sand 48 a, 6230 Frankfurt am Main 80, Fed. Rep. of Germany

[21] Appl. No.: 692,281

[22] Filed: Jan. 16, 1985

[30] Foreign Application Priority Data

Apr. 18, 1984 [DE] Fed. Rep. of Germany ..... 3414637
Nov. 2, 1984 [DE] Fed. Rep. of Germany ..... 3440179

[51] Int. Cl.[4] ..... A41B 9/00
[52] U.S. Cl. ..... 2/400
[58] Field of Search ..... 2/403, 400, 406

[56] References Cited

U.S. PATENT DOCUMENTS

| | | | |
|---|---|---|---|
| 2,669,726 | 2/1954 | Miesel | 2/221 |
| 3,083,710 | 4/1983 | Rauser | 128/159 |
| 3,525,336 | 8/1970 | Wadman | 2/403 |
| 4,280,229 | 7/1981 | Stein | 2/221 |

FOREIGN PATENT DOCUMENTS

| | | |
|---|---|---|
| 7106053 | 2/1971 | Fed. Rep. of Germany . |
| 634618 | 3/1950 | United Kingdom . |
| 1369467 | 10/1974 | United Kingdom . |

*Primary Examiner*—Doris L. Troutman
*Attorney, Agent, or Firm*—Andrus, Sceales, Starke & Sawall

[57] ABSTRACT

A panty-like garment (12) of textile material comprising a waistband (10) whose width corresponds to about one-quarter to one-half, preferably to about one-third, of the overall length (L) of the garment (12).

14 Claims, 1 Drawing Figure

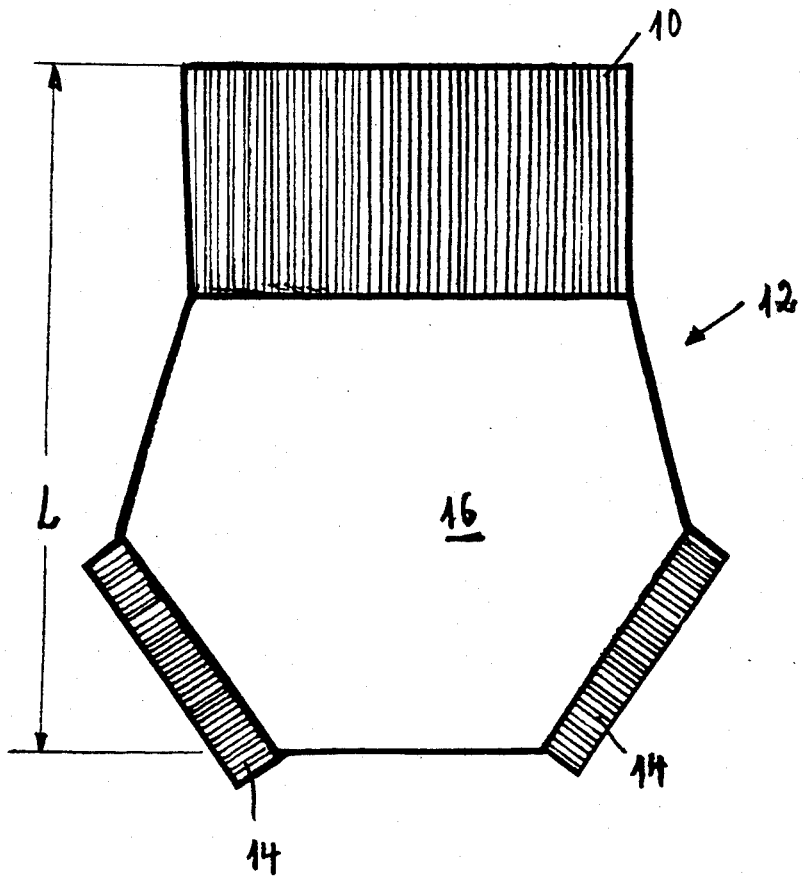
10
12
L
16
14
14

PANTY-LIKE GARMENT OF TEXTILE MATERIAL

The invention relates to a panty-like garment of textile material, especially for babies and small children.

All of the presently available babies' and children's panties typically comprise a relatively narrow waistband, mostly in the form of a mere elastic band, and only slightly stretchable leg bands. These panties have the drawback that vests are retained only very unsatisfactorily by the waistband, so that at the slightest movement of the baby or small child the vest will slip out, this being further promoted in most cases by the napkins being drawn down due to kicking or walking motions performed by the child. In that case the back and the particularly tender renal region of the baby or small child are frequently fully exposed, and consequently the child may catch a chill very easily.

Until recently, one sought to overcome this problem by the use of one-piece combinations. However, these combinations have the drawback that the child has to be completely dressed or undressed, respectively, if the lower or upper part of the garment gets wet. Such a change of garment is not very pleasant either for the child or its parents.

The present invention is therefore based on the object of providing a panty-like garment of the type specified above, which provides a reliable protection for the back and renal region even in case of strong kicking, crawling and walking motions of the child and is comfortable to wear.

In accordance with the invention the above-specified object is solved in a surprisingly simple way by providing a waistband whose width corresponds to about one-fourth to one-half, preferably to about one-third, of the overall length of the garment or panty.

Thereby it is ensured that the back and renal region of the child is always covered even if the vest or the like inadvertently slips out from beneath the waistband. The particularly wide waistband is moreover distinguished by a high degree of pliancy. Any constriction such as found, for instance, with the conventional elastic bands, is thereby avoided. The child's waist region is not subjected to any unpleasant compression. The panty is relatively slip-proof and will hold together any napkin material even if the latter is wet.

In a preferred embodiment, the leg bands also are relatively wide and are made of elastically stretchable textile or stretch material, respectively; the width of each leg band is about one-fifth to one-half, preferably about one-third of the width of the mentioned waistband. Thereby a reliable fit of the panty is also ensured in the leg region, and consequently any slipping-down of napkin material is prevented. Due to the broad configuration of the leg bands and the material employed, the garment according to the invention is very comfortable to wear also in the leg region.

In accordance with a further development of the invention, the panty portion which is defined by the waistband, on the one hand, and the leg bands, on the other hand, is made of highly elastic and absorptive textile material, preferably of frotté-stretch material, having a minimum elongation of about 30 to 50%. Such a material is very pleasant to the skin and does not in any way impede the movements of the baby or small child. In summary, therefore, the invention represents a compact panty distinguished by high pliancy and strength without having a constricting or compressive effect. It is ensured that the tender back and renal region of the baby or small child is always covered. Moreover, any napkin material is confined in a slipproof way inside the panty. Due to the elongation of the panty material required in accordance with the invention, especially of the panty portion itself, it is possible to provide a relatively large amount of napkin material. Also, due to the required minimum elongation the panty, as it were, may grow with the baby or small child, respectively. One and the same panty will fit a new-born baby as well as a child of about one year, provided the initial size is chosen accordingly. The same holds for a larger initial size. In addition to the above-specified advantages it is thereby even possible to save money.

As regards the preferred material composition, reference is made to the claims 5 and 7, 8.

An embodiment of the panty or briefs according to the invention will be described below with reference to the accompanying drawing.

The drawing shows an unfolded panty, comprising a wide waistband 10 and relatively wide leg bands 14, each of said bands being circular knitted. The waistband 10, on the one hand, and the leg bands 14, on the other hand, define the actual panty 16 consisting of absorptive and highly elastic frotté-stretch material having a minimum elongation of about 30 to 50%, preferably of about 40%. The waistband 10 and the leg bands 14 are made of about 60 to 100% of cotton; the remainder is made of Elasthan (registered trademark) or the like synthetic fibre material. Preferably, the composition comprises 90% of cotton and 10% of Elasthan.

The panty portion 16 is made of about 60 to 90% of cotton and about 40 to 10% of nylon (registered trademark) or the like synthetic fibre material.

Moltopren yarns may be worked into the waistband 10 and the leg bands 14 in order to improve the elasticity thereof.

As will be apparent from the drawing, the width of the leg bands 14 is about one-fourth of the width of the waistband 10. With babies' and children's panties the width of the waistband 10 is about 8 cm. It is further apparent from the drawing that the width of the waistband 10 corresponds to about one-third of the overall length L of the panty 12 as measured from the free periphery of the waistband 10 to the crotch between the two leg bands 14.

Of course, if possible, the material used should be fast to boiling. The above-mentioned materials for the various components of the panty meet this requirement. The panty may also be very useful for adults, in particular for those having sensitive kidneys or the like.

All of the features disclosed in the present papers are claimed as being essential to the invention insofar as they are novel over the prior art either individually or in combination.

We claim:

1. A panty-like garment of textile material especially adapted for babies, comprising a body member (16) of an elastically stretchable and absorptive textile material, a waistband (10) and leg bands secured to said body member, said waistband being of an elastically stretchable material and having a width in the range of about one-fourth to one-half of the overall length (1) of the body member (16), said leg bands being of an elastically stretchable material and each having a width in the range of about one-fifth to one-half of the width of said waistband.

2. The panty-like garment of claim 1 wherein said waist band has a width of substantially one-third the overall length.

3. The garment of claim 1 wherein the width of the waistband (10) is about 6 to 10 cm.

4. The garment of claim 3 wherein said width is substantially 8 cm.

5. The garment of claim 1 wherein said waistband is formed of a circular knitted material.

6. The garment of claim 1 having leg bands (14) having a minimum elongation of between 70 to 100%.

7. The garment of claim 6 wherein said leg bands are formed of a circular knitted material.

8. The garment of claim 1 wherein said leg bands have a width of substantially one-third of the width of the waistband.

9. The garment as claimed in claim 6 wherein each of said waistband (10) and said leg bands (14) include a moltopren yarn.

10. The garment of claim 1 wherein said body portion material being stretched by at least about 30 to 50%.

11. The garment of claim 10 wherein said body portion (16) consists of about 60 to 90% of cotton and about 40 to 10% a synthetic fibre material such as nylon.

12. The garment of claim 1 wherein said body portion is made of frotte-stretch material.

13. The garment of claim 1 wherein said waistband (10) and said leg bands (14) each include about 60 to 100% of cotton, the remainder being a synthetic fibre material of Elasthan or like material.

14. The garment of claim 13 wherein said waistband and leg bands each include 90% cotton and 10% of Elasthan.

* * * * *